US009557698B2

(12) United States Patent
Muramoto et al.

(10) Patent No.: US 9,557,698 B2
(45) Date of Patent: Jan. 31, 2017

(54) INFORMATION PROCESSING APPARATUS, INFORMATION PROCESSING METHOD, AND COMPUTER-READABLE STORAGE MEDIUM FOR DETECTING AN ABNORMITY FROM SOUND DATA

(71) Applicants: Yohsuke Muramoto, Kanagawa (JP); Hiroaki Fukuda, Kanagawa (JP); Yasunobu Shirata, Tokyo (JP); Junichi Takami, Kanagawa (JP)

(72) Inventors: Yohsuke Muramoto, Kanagawa (JP); Hiroaki Fukuda, Kanagawa (JP); Yasunobu Shirata, Tokyo (JP); Junichi Takami, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/937,250

(22) Filed: Nov. 10, 2015

(65) Prior Publication Data

US 2016/0147187 A1 May 26, 2016

(30) Foreign Application Priority Data

Nov. 20, 2014 (JP) ..... 2014-235228
Jun. 22, 2015 (JP) ..... 2015-125127

(51) Int. Cl.
*G03G 15/00* (2006.01)

(52) U.S. Cl.
CPC ..... *G03G 15/5062* (2013.01)

(58) Field of Classification Search
USPC ..... 399/9, 10, 12, 16, 18, 31
See application file for complete search history.

(56) References Cited

U.S. PATENT DOCUMENTS 7,603,047 B2 * 10/2009 Akashi ..... G03G 15/5058 399/302
8,036,546 B2 * 10/2011 Misumi ..... G03G 15/5079 399/36
8,571,461 B2 * 10/2013 Ohnishi ..... G03G 15/6529 399/405
8,925,921 B2 * 1/2015 Morikawa ..... H04N 1/00689 271/258.01
2013/0155437 A1 6/2013 Muramoto
2015/0098587 A1 4/2015 Aiba et al.

FOREIGN PATENT DOCUMENTS

JP H09-200414 7/1997
JP 2006-184722 7/2006
JP 2012-177748 9/2012

OTHER PUBLICATIONS

U.S. Appl. No. 14/621,880, filed Feb. 13, 2015.
U.S. Appl. No. 14/618,603, filed Feb. 10, 2015.

* cited by examiner

*Primary Examiner* — Hoan Tran
(74) *Attorney, Agent, or Firm* — Harness, Dickey & Pierce, P.L.C.

(57) ABSTRACT

An information processing apparatus includes a sound collector configured to collect an operation sound of a sound collection target device to obtain sound data; a context information obtaining unit configured to obtain context information at a time of an operation of the sound collection target device; a feature generator configured to generate feature of sound data corresponding to the context information; and a clustering unit configured to generate an operation status table of the sound collection target device by using the feature.

8 Claims, 10 Drawing Sheets

INFORMATION PROCESSING APPARATUS, INFORMATION PROCESSING METHOD, AND COMPUTER-READABLE STORAGE MEDIUM FOR DETECTING AN ABNORMITY FROM SOUND DATA

CROSS-REFERENCE TO RELATED APPLICATIONS

The present application claims priority to and incorporates by reference the entire contents of Japanese Patent Application No. 2014-235228 filed in Japan on Nov. 20, 2014 and Japanese Patent Application No. 2015-125127 filed in Japan on Jun. 22, 2015.

BACKGROUND OF THE INVENTION

1. Field of the Invention

The present invention relates to an information processing apparatus, an information processing method, and a computer-readable storage medium.

2. Description of the Related Art

In a field of an image forming device, known has been a technique of comparing operation sound data obtained by collecting sounds by a sound collector with operation sound data prepared in advance for each of operation statuses based on context information to detect an abnormity.

Specifically, Japanese Laid-open Patent Publication No. 2006-184722 discloses an image forming device including a function of comparing operation sound data, collected and stored in advance, of units (a drum motor, a paper feeding motor, a fixing motor, a developing clutch, and the like) with operation sound data collected by operating the image forming device, making a detection as an abnormal sound when a difference therebetween is equal to or more than a predetermined level, and specifying a unit causing the abnormal sound by using an operation sequence table of each of the units, for example.

Besides, Japanese Laid-open Patent Publication No. 2012-177748 discloses an image forming device including a function of making a comparison with data, collected and stored in advance, of abnormal sounds caused in each part when an operation sound, collected by operating the image forming device, of each part increases and determining an abnormity when the operation sound corresponds to the abnormal sound data.

However, those techniques of detecting an abnormity by using context information and operation sound data require operation sound data for each of operation statuses, which leads to a problem of causing a relative reduction in an amount of operation sound data available for each of the operation statuses, a deterioration in an approximation accuracy of a model expressing operation sounds, and a deterioration in a detection accuracy as a result.

This problem will be explained with reference to Tables 1 and 2 below. Here, Table 1 illustrates an example of context information and Table 2 illustrates examples of operation statuses by taking the context information into account.

TABLE 1

| No. | Context information | Operation flag |
|---|---|---|
| 1 | Driving motor of fixing unit | ON/OFF |

TABLE 1-continued

| No. | Context information | Operation flag |
|---|---|---|
| 2 | Conveyance motor | ON/OFF |
| 3 | Speed-up zone of paper | Paper present/Paper not present |
| 4 | Manual conveyance motor | ON/OFF |
| 5 | Ozone fan | ON/OFF |
| 6 | Number of rotations of ozone fan | Low/High |
| 7 | Light emission of LED | ON/OFF |
| 8 | Remaining amount of toner | Small/Large |
| 9 | Manual conveyance roller | ON/OFF |

TABLE 2

| No. | Context information | Operation status 1 | Operation status 2 | Operation status 3 | . . . |
|---|---|---|---|---|---|
| 1 | Driving motor of fixing unit | ON | OFF | OFF | . . . |
| 2 | Conveyance motor | ON | ON | OFF | . . . |
| 3 | Speed-up zone of paper | Paper not present | Paper not present | Paper present | . . . |
| 4 | Manual conveyance motor | ON | OFF | ON | . . . |
| 5 | Ozone fan | ON | ON | OFF | . . . |
| 6 | Number of rotations of ozone fan | Low | High | — | . . . |
| 7 | Light emission of LED | ON | ON | OFF | . . . |
| 8 | Remaining amount of toner | Small | Small | Large | . . . |
| 9 | Manual conveyance roller | OFF | OFF | ON | . . . |

In Table 1, an operation flag of each of items for the context information is defined by 0/1 (two conditions by division with a threshold in a case of an analog quantity). In using the context information of all the items in Table 1, the number of possible operation statuses is $2^9$ (=512) (however, the actual number of possible operation statuses becomes smaller to some extent since there exist some impossible operation statuses). Examples of operation statuses on this occasion are illustrated in Table 2. While only three kinds of examples are illustrated here, there are, in fact, 512 kinds of assumable operation statues in total.

In assuming a collection of an actual operation sound data, the data amount of collectable operation sounds has a limit in practice due to a capacity of a storage medium, difficulty in reproducing operation statuses, and the like. Especially, for collecting abnormal operation sound data, a human person is required to keep collecting sounds by operating the device and to judge and extract abnormal sounds that have occurred incidentally, and is not able to generate at will and freely collect such abnormal sounds.

On the assumption that the data amount of collectable operation sounds is constant since the data amount is limited in practice as explained, the reason why an approximation accuracy of a model is deteriorated will be explained. A model is configured to be expressed by mean and variation. Generally speaking, in using and expressing by mean and variation a certain data group, a larger amount of data enables more accurate expression of the data group by the mean and the variation. However, in a case where the data amount is insufficient, it is difficult to see a distribution state of the entirety of the data, which causes deterioration in validity of the mean and the variation. This situation is described as "approximation accuracy is low". Therefore, an insufficient data amount causes a low approximation accuracy of the model.

On the assumption that context information includes nine items illustrated in FIG. 1 and there is data of 512 sounds, the number of operation statuses becomes $2^9$ (=512) since the number of pieces of context information directly affects the number of operation statuses. Therefore, the number of sounds as data to be allotted to one operation status is "one in the mean". The reason of using the expression "mean" is that there is non-existent operation status and there are multiple operation statuses in the data of 512 sounds.

As explained above, there is a problem that the number of pieces of data to be allotted to one operation status is small, the approximation accuracy of a model expressing operation sounds is deteriorated, and the accuracy of the detection of abnormal sounds becomes low in the conventional techniques of performing a clustering on (dividing) operation statuses for the number of pieces of context information.

Therefore, there is a need for an information processing apparatus, an information processing method, and a computer-readable storage medium, capable of enhancing the approximation accuracy of model expressing operation sounds of a device such as an image forming device and improving the accuracy of the detection of abnormal sounds.

SUMMARY OF THE INVENTION

It is an object of the present invention to at least partially solve the problems in the conventional technology.

According to an embodiment, there is provided an information processing apparatus that includes a sound collector configured to collect an operation sound of a sound collection target device to obtain sound data; a context information obtaining unit configured to obtain context information at a time of an operation of the sound collection target device; a feature generator configured to generate feature of sound data corresponding to the context information; and a clustering unit configured to generate an operation status table of the sound collection target device by using the feature.

According to another embodiment, there is provided an information processing method in an information processing apparatus. The information processing method includes collecting an operation sound of a sound collection target device to obtain sound data; obtaining context information at a time of an operation of the sound collection target device; generating feature of sound data corresponding to the context information; and generating an operation status table of the sound collection target device by using the feature.

According to still another embodiment, there is provided a non-transitory computer-readable storage medium with an executable program stored thereon and executed by a computer of an information processing apparatus. The program instructs the computer to perform: collecting an operation sound of a sound collection target device to obtain sound data; obtaining context information at a time of an operation of the sound collection target device; generating feature of sound data corresponding to the context information; and generating an operation status table of the sound collection target device by using the feature.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A first embodiment will be explained below with reference to the accompanying drawings.

System for Collecting Operation Sounds of Image Forming Device

Figure 1:
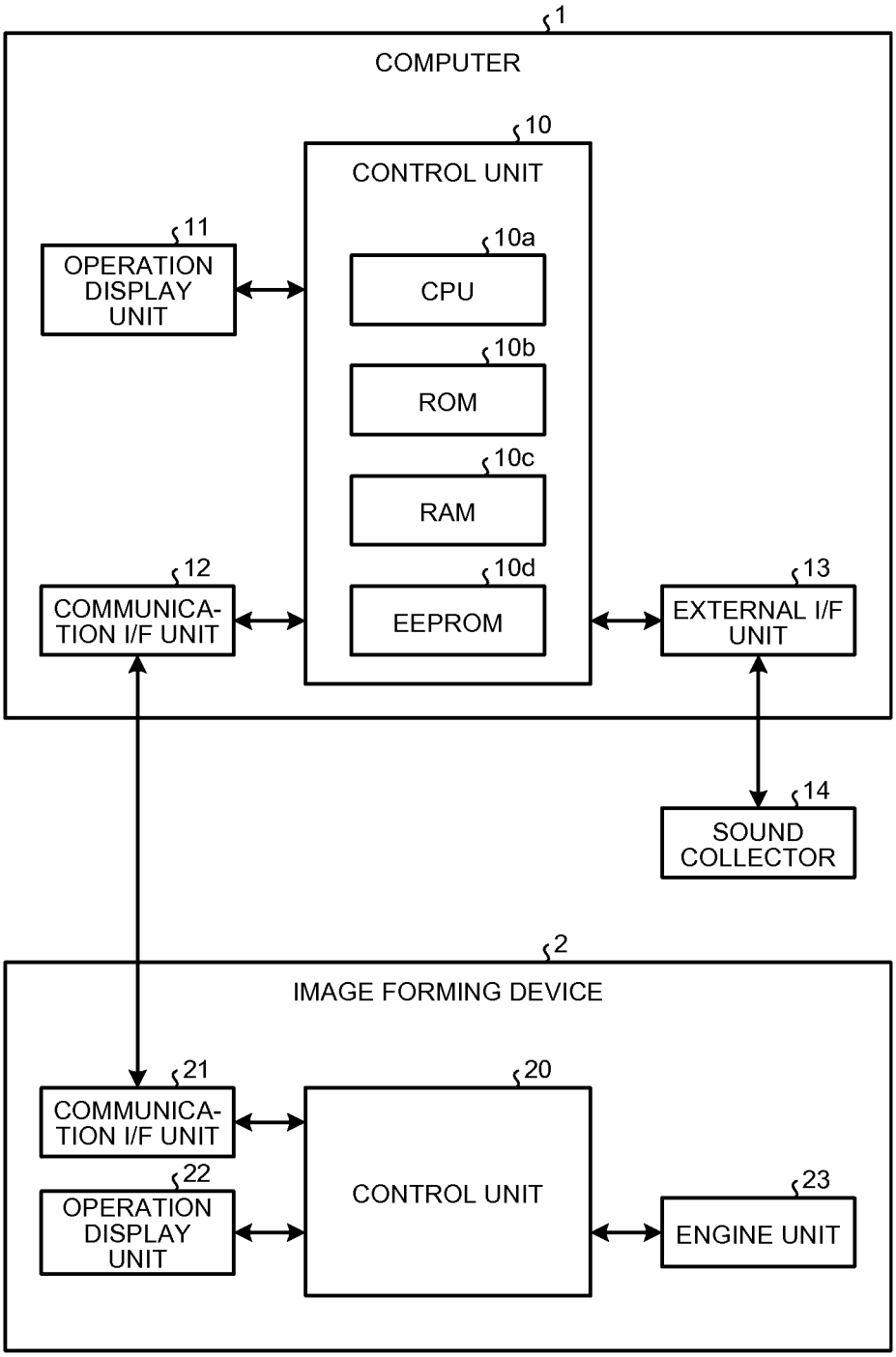
FIG. 1 illustrates a configuration of a system in which operation sounds of an image forming device are collected by an information processing apparatus according to a first embodiment.

FIG. 1 illustrates a configuration of a system (hereinafter referred to as "the system") in which operation sounds of an image forming device are collected by an information processing apparatus according to an embodiment. As illustrated in FIG. 1, the system includes a computer 1 as an information processing apparatus and an image forming device 2 as a sound collection target device whose operation sounds are collected.

The computer 1 is provided with a control unit 10, an operation display unit 11, a communication I/F (interface) unit 12, and an external I/F unit 13, to which a sound collector 14 that collects data of operation sounds of the image forming device 2 is connected. The image forming device 2 is provided with a control unit 20, a communication I/F unit 21, an operation display unit 22, and an engine unit 23.

The control unit 10 of the computer 1 is provided with a CPU 10*a*, a ROM 10*b*, a RAM 10*c*, and an EEPROM 10*d*. The control unit 10 executes, by the CPU 10*a*, a control program stored in the ROM 10*b* to totally control the computer 1. In the ROM 10*b*, the control program that causes the CPU 10*a* to execute processing of various kinds is stored in advance. The RAM 10*c*, which is a volatile storage unit, is used as a temporary storage unit of data for the processing of various kinds to be executed by the CPU 10*a*. The EEPROM 10*d*, which is a non-volatile storage unit, is used for storing setting information of the computer 1, data of operation sounds which are collected from the image forming device 2, and information like an operation status table. Here, a non-volatile storage unit such as a hard disk and an SSD (Solid State Dive) may be provided in place of or together with the EEPROM 10*d*.

The operation display unit 11, which is provided with an input device such as a keyset and a mouse and an output device such as a liquid crystal display, performs an input of an instruction through a manipulation by a user and a display of an operation status of the computer 1. The communication I/F unit 12 enables a communication of control signals and data with the communication I/F unit 21 of the image forming device 2 based on the control of the control unit 10. The external I/F unit 13 enables inputting data of sounds, collected by the sound collector 14, of the image forming device 2 to the control unit 10.

The control unit 20 of the image forming device 2, which is provided with a CPU, a ROM, a RAM, and an EEPROM similarly to the control unit 10 of the computer 1, totally controls the entirety of the image forming device 2.

The communication I/F unit 21 enables a communication of control signals and data with the communication I/F unit 12 of the computer 1 based on the control of the control unit 20. The operation display unit 22, which is provided with a display device such as a liquid crystal display and various operation buttons, performs an input of an instruction through a manipulation by a user and a display of an operation status of the image forming device 2. The engine unit 23 is provided with motors and sensors of various kinds which are necessary for an image forming operation of forming and outputting image data on a sheet of paper, an exposure device, a photoconductive drum, a developing device, a paper conveyance mechanism, and the like.

Block Diagram of Computer

Figure 2:
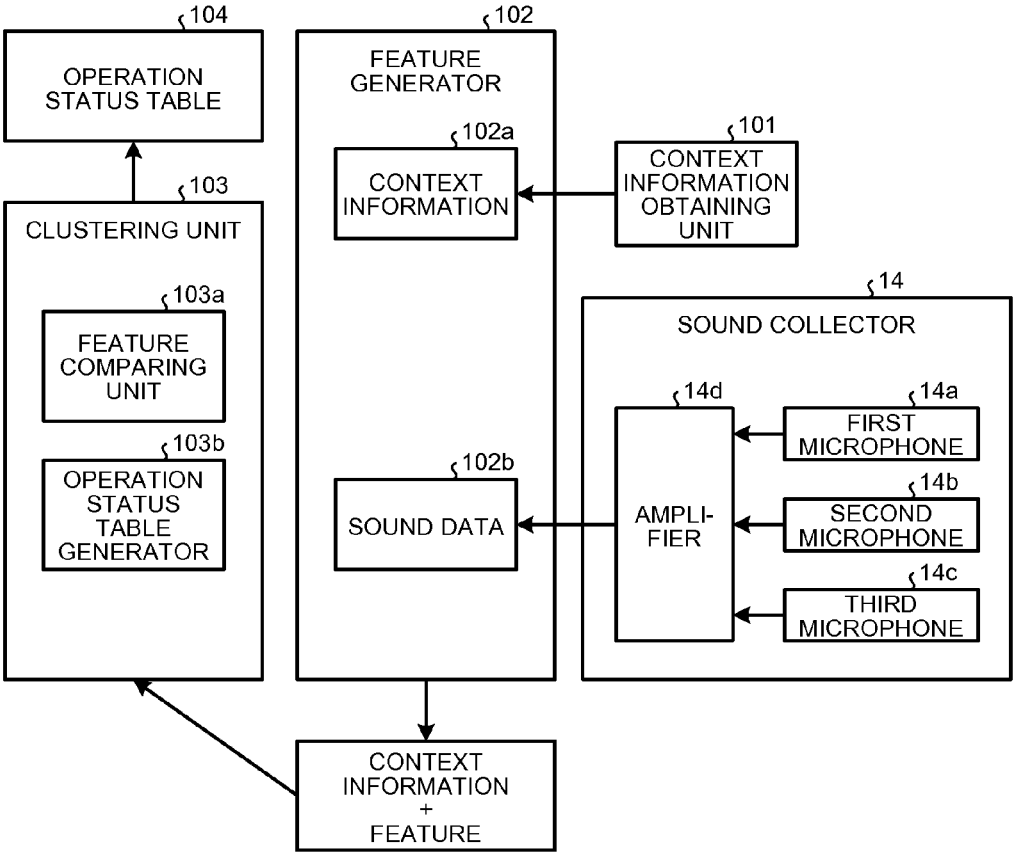
FIG. 2 is a block diagram for explaining a function of the information processing apparatus according to the first embodiment.
Figure 3:
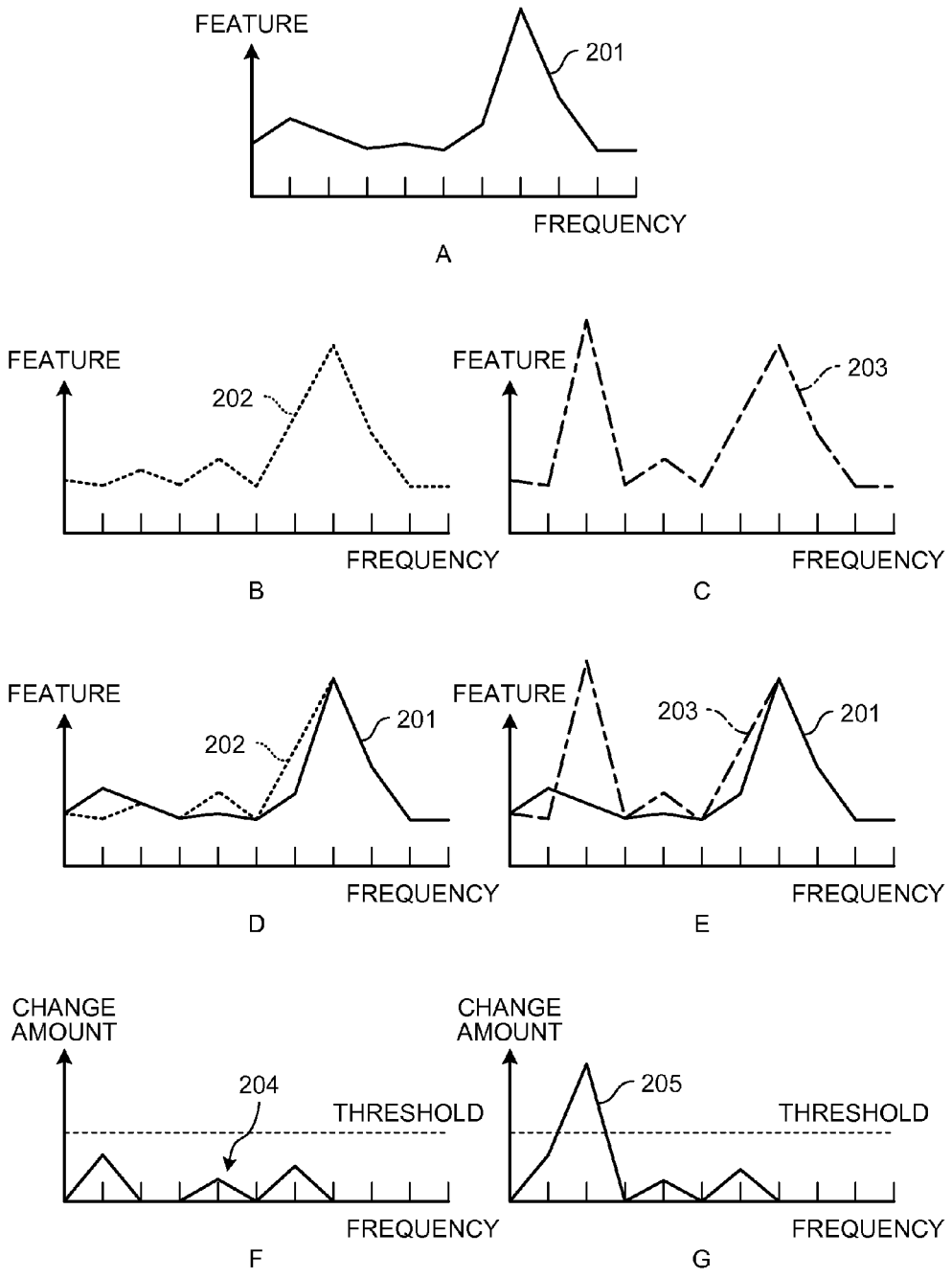
FIG. 3 illustrates graphs for explaining operations of a feature generator and a feature comparing unit according to the first embodiment.

FIG. 2 is a block diagram for explaining a function of the computer 1. FIG. 3 illustrates graphs for explaining operations of the feature generator and the feature comparing unit in FIG. 2.

As illustrated in FIG. 2, the computer 1 is provided with a context information obtaining unit 101, a feature generator 102, a clustering unit 103, and the sound collector 14. Here, the context information obtaining unit 101, the feature generator 102, and the clustering unit 103 are functional blocks realized by an operation sound collecting program stored in the ROM 10*b* in FIG. 1. The operation sound collecting program may be provided as a computer-readable storage medium storing therein.

The context information obtaining unit 101 obtains context information 102*a* from the image forming device 2 via the communication I/F unit 12 and outputs the context information 102*a* to the feature generator 102. The image forming device 2 is capable of operating the device at an arbitrary context state by an SP mode. The context information to be obtained on this occasion is the same as what is illustrated in Table 1. Here, an item of the context information is referred to as "context item" and the number of the context item is referred to as "context number" in the explanation below. Besides, the context item corresponding to the context number 1 is referred to as "context item 1". The same applies to the other context information corresponding to each of the other context numbers.

The sound collector 14 is provided with first to third microphones 14*a* to 14*c* and an amplifier 14*d*. These microphones are arranged at appropriate positions of the image forming device 2 depending on operation sounds to detect in the image forming device 2. The total number of the microphones is at least one and may be more.

The first to third microphones 14*a* to 14*c* convert an operation sound of the image forming device 2 into an analog electric signal and the amplifier 14*d* amplifies the analog electric signal from each of the microphones, digitalizes the electric signal into sound data 102*b*, and outputs the sound data 102*b* to the feature generator 102 via the external I/F unit 13 (see FIG. 1). Here, any of "sound data", "data", "feature data", and the like in the embodiment is "data which is obtained by digitalizing an analog electric signal".

In focusing attention on a driving motor of a fixing unit (No. 1) for the context information, ON/OFF states of the other items (No. 2 to 9) are assumed to be the same and two kinds of sound data for a case where only the driving motor of the fixing unit is at ON state and a case where only the driving motor of the fixing unit is at OFF state is obtained. Similarly, in focusing attention on any one of the other items, ON/OFF states of the other items except for the focused item are assumed to be the same and two kinds of sound data for the case where only the focused item is at ON state and the case where only the focused item is at OFF state is obtained.

The feature generator 102 generates feature data from the input sound data 102*b*. Here, 8 to 64 dimensional data in which frequency property of sound data is compressed is used as feature data. Since the feature data is well known and described in detail in Japanese Laid-open Patent Publication No. 9-200414, for example, the detailed content will not be explained here. The feature generator 102 outputs the feature data generated in this manner and the context information to the clustering unit 103.

The clustering unit 103 is provided with a feature comparing unit 103*a* and an operation status table generator 103*b*.

The feature comparing unit 103*a* compares feature data of two kinds of sound data for ON state and OFF state for each context item and determines a presence or an absence of influence on operation sound based on whether the feature data for two statues have a gap equal to or more than a predetermined threshold. In other words, when the gap between the feature data when the driving motor of the fixing unit for the context item 1 is at ON state and the feature data when the driving motor of the fixing unit for the context item 1 is at OFF state is, for example, less than a threshold, the driving motor of the fixing unit is determined to have no influence on operation sound and when the gap of the feature data is equal to or more than the threshold, the driving motor of the fixing unit is determined to have an influence on operation sound. Specifically, the presence or the absence of influence on operation sound for a certain context item means whether or not a change in an operation flag of the context item has an influence on operation sound. In terms of operation sound, the presence or the absence of influence on operation sound for a certain context item means whether or not operation sound is influenced by (subject to) the change in an operation flag of the context item.

More concrete explanation will be made with reference to FIG. 3. Feature data 201 illustrated in FIG. 3A is configured to be feature data when "the driving motor of the fixing unit" is at OFF state, and feature data 202 illustrated in FIG. 3B and feature data 203 illustrated in FIG. 3C is configured to be feature data when the "driving motor of the fixing unit" is at ON state. Here, context information of the other items is all at OFF state. In FIGS. 3A to 3C, the horizontal axis indicates a frequency of sound data and the longitudinal axis indicates feature data (intensity of sound data).

First, a case where a gap in data between ON state and OFF state is small will be explained. FIG. 3D illustrates the feature data 201 and the feature data 202 as one feature-to-frequency property. FIG. 3F illustrates a change amount (gap) 204 between the feature data 201 and the feature data 202 and a threshold. In FIG. 3F, the gap is less than the threshold in all dimensions (10 dimensions, here) in frequency. In this case, the "driving motor of the fixing unit" of the context information is determined to have no influence on operation sound. Here, it is possible to change the threshold arbitrarily.

Next, a case where the gap in data between ON state and OFF state is large will be explained. FIG. 3E illustrates the feature data 201 and the feature data 203 as one feature-to-frequency property. FIG. 3G illustrates a change amount (gap) 205 between the feature data 201 and the feature data 203 and a threshold. In FIG. 3G, there is a point at which the change amount is equal to or more than the threshold in a specific dimension. Therefore, the "driving motor of the fixing unit" of the context information is determined to have an influence on operation sound.

An example of a determination result concerning an influence on operation sound for each context item is illustrated in Table 3 below.

TABLE 3

| No. | Context information | Presence/absence of influence on operation sound |
|---|---|---|
| 1 | Driving motor of fixing unit | YES |
| 2 | Conveyance motor | NO |
| 3 | Speed-up zone of paper | NO |
| 4 | Manual conveyance motor | YES |
| 5 | Ozone fan | NO |
| 6 | Number of rotations of ozone fan | NO |
| 7 | Light emission of LED | NO |
| 8 | Remaining amount of toner | NO |
| 9 | Manual conveyance roller | YES |

Here, the driving motor of the fixing unit (item No. 1), the manual conveyance motor (item No. 4), and the manual conveyance roller (item No. 9) are determined to have an influence on operation sound. Since it is possible to predict that the light emission of LED (item No. 7) has no influence on operation sound, an obtainment of sound data and context information thereof may be omitted.

The explanation goes back to FIG. 2. The operation status table generator 103*b* generates and writes in the EEPROM 10*d* an operation status table 104 based on the presence/absence, determined by the feature comparing unit 103*a*, of influence on operation sound for each context item.

An example of the operation status table is illustrated in Table 4 below.

TABLE 4

| Operation status | Context item number 1 | 4 | 9 | Others |
|---|---|---|---|---|
| 1 | ON | ON | ON | UNCONCERNED |
| 2 | ON | ON | OFF | UNCONCERNED |
| 3 | ON | OFF | ON | UNCONCERNED |
| 4 | ON | OFF | OFF | UNCONCERNED |
| 5 | OFF | ON | ON | UNCONCERNED |
| 6 | OFF | ON | OFF | UNCONCERNED |
| 7 | OFF | OFF | ON | UNCONCERNED |
| 8 | OFF | OFF | OFF | UNCONCERNED |

In the case of this example, there are three context items which have influence on operation sound among nine context items. It is therefore possible to reduce the number of operation statuses from conventional $2^9$ (=512) to $2^3$ (=8). Hence, it is possible to increase the number of pieces of sound data to be allotted to one operation status from the conventional "mean 1" to "mean 64" on the assumption that the number of pieces of sound data is 512. The point here is to perform clustering of operation statuses by determining context information in a quantitative way as explained and extracting only the context items having an influence on operation sound.

First Example of Procedure of Generating Operation Status Table

Figure 4:
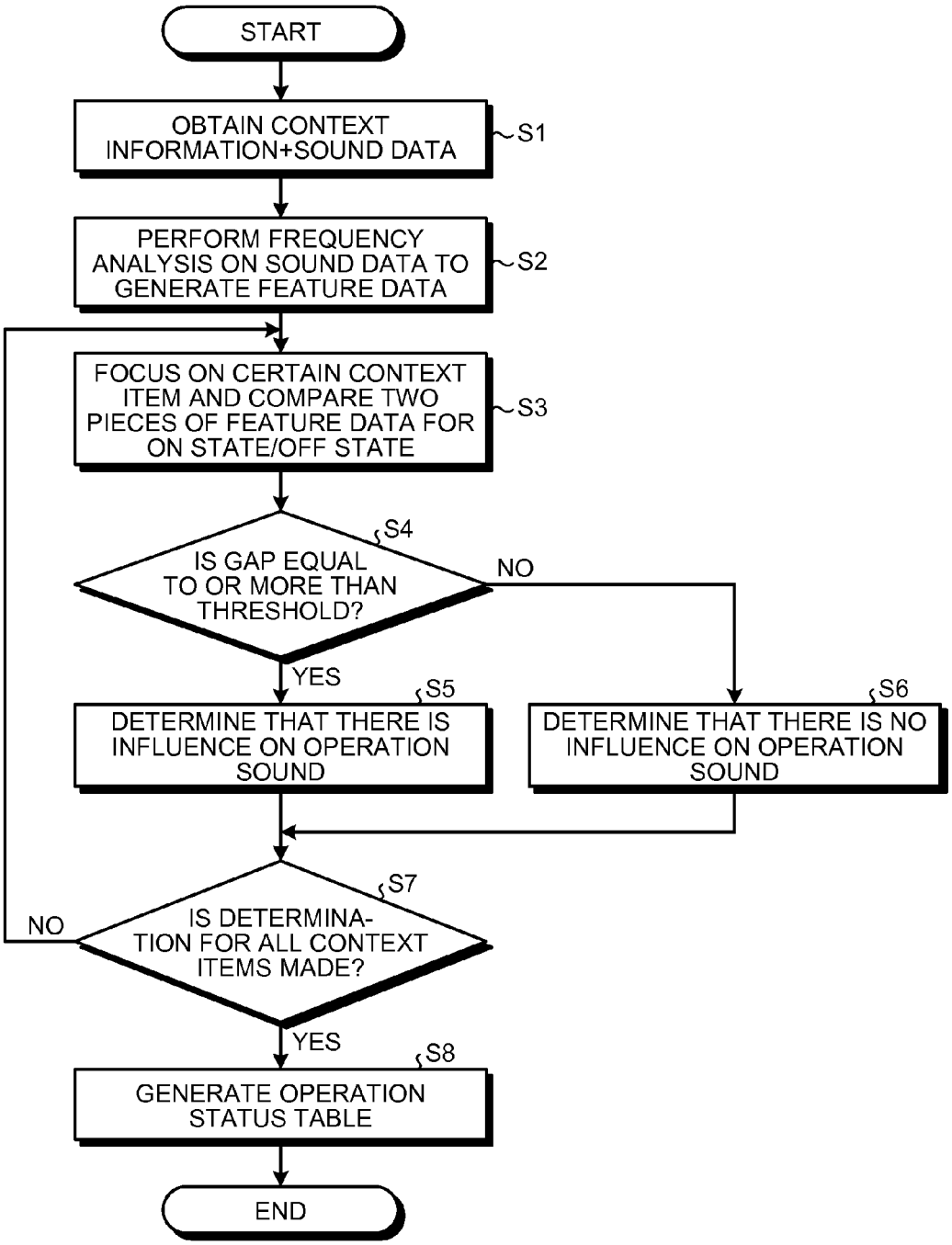
FIG. 4 is a flowchart of a first example of a procedure of generating an operation status table in the information processing apparatus according to the first embodiment.

FIG. 4 is a flowchart of a first example of a procedure of generating an operation status table in the computer 1. By the first example of a procedure of generating an operation status table, it is possible to generate the determination result explained already and illustrated in Table 3 and the operation status table illustrated in Table 4.

The context information obtaining unit 101 first obtains and transmits to the feature generator 102 the context information 102*a*, and the sound collector 14 generates and transmits to the feature generator 102 the sound data 102*b*. The feature generator 102 thus obtains the context information 102*a* and the sound data 102*b* (step S1).

The feature generator 102 next analyzes the sound data 102*b* to make feature as data, i.e., to generate feature data (step S2). The feature generator 102 transmits the feature data and the context information 102*a* to the clustering unit 103.

The feature comparing unit 103*a* constituting the clustering unit 103 focuses on a certain context item, compares two pieces of feature data for the ON state and the OFF state (step S3), and determines whether or not the gap is equal to or more than the threshold (step S4).

When the gap is equal to or more than the threshold as a result of the determination ("Yes" at step S4), the feature comparing unit 103*a* determines that the context item has an influence on operation sound (step S5) and when the gap is less than the threshold ("No" at step S4), the feature comparing unit 103*a* determines that the context item has no influence (step S6). Until making determination with respect to all the context items ("No" at step S7), steps S3 to S6 are to be repeated and when determination is made with respect to all the context items ("Yes" at step S7), the operation status table generator 103*b* generates the operation status table 104 (step S8) and the flow illustrated in FIG. 4 is ended.

The feature comparing unit 103*a* functions as an item detector that detects a context item having an influence on operation sound in executing steps S3 to S7. The operation status table generator 103*b* functions as a first operation status table generator in executing step S8.

Second Example of Procedure of Generating Operation Status Table

In the first example of procedure of generating an operation status table, the clustering is performed by considering only an influence, of each focused context item, on operation sound. In a second example to be explained from now on, the clustering is performed by taking an influence by other context items on operation sound into consideration.

A simple example will first be explained. While it is already known that the context item 1 has an influence on operation sound, the context item 1 becomes ON state only under a situation where the context item 2 is at ON state. It is also already known that the context item 2 has an influence on operation sound and the impact on the operation sound is very significant. In this case, due to the influence by the context item 2, it is of no meaning to perform clustering by focusing on the ON/OFF of the context item 1 even because the context item 1 has an influence on operation sound. The second example deals with this case and includes an algorithm of performing clustering by taking mutual relationship of context items into consideration.

Figure 5:
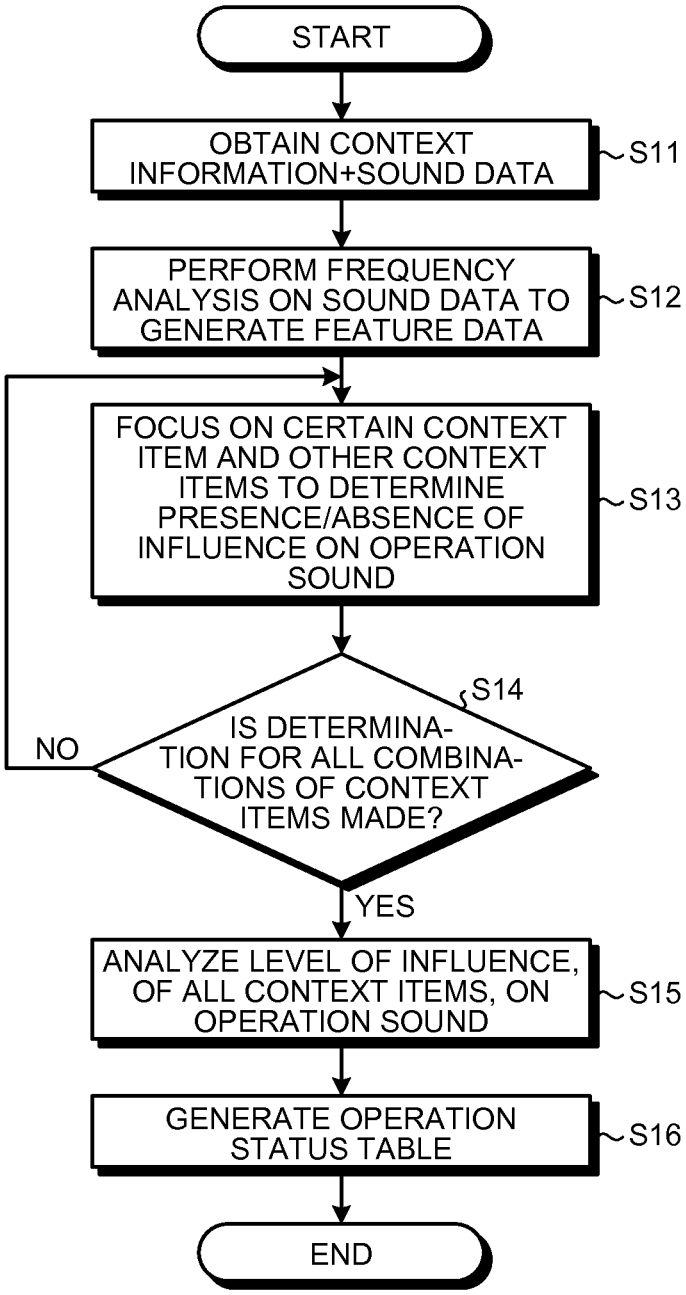
FIG. 5 is a flowchart of a second example of a procedure of generating an operation status table in the information processing apparatus according to the first embodiment.

FIG. 5 is a flowchart of a second example of a procedure of generating an operation status table in the computer 1. An explanation will be made below with reference to this flowchart.

Similarly to the first example, the context information obtaining unit 101 and the sound collector 14 first respectively obtain context information and sound data (step S11) and the feature generator 102 performs a frequency analysis on the sound data to generate feature data (step S12).

Next, the feature comparing unit 103*a* focuses on a certain context item and the other context items and determines whether or not there is an influence on operation sound (step S13). In other words, the presence/absence of the influence on operation sound at ON/OFF state of the focused context item while the other context items are in operation at ON state is determined.

Until making determination concerning all combinations of the context items here ("No" at step S14), step S13 is to be repeated and when determination is made for all the combinations ("Yes" at step S14), the feature comparing unit 103*a* analyzes a level of influence on operation sound with respect to all the context items (step S15).

By repeating step S13 until making determination concerning all the combinations of the context items ("No" at step S14), data of influence level on operation sound of the context items, in which influencing context items as illustrated in Table 5 below are taken into consideration is generated.

TABLE 5

| | | Influencing context item | | | |
|---|---|---|---|---|---|
| | | 1 | 2 | 3 | 4 |
| Focused context item | 1 | — | No | No | No |
| | 2 | Yes | — | Yes | No |
| | 3 | Yes | Yes | — | No |
| | 4 | Yes | Yes | Yes | — |

In this Table 5, an index in the longitudinal direction (column direction) is a context item which is focused (focused context item) and an index in the horizontal direction (row direction) is a context item which is at ON state with the focused context item at the same time (influencing context item). The other context items except for these two are all at OFF state.

For example, the second column from the left in the fourth row from the top indicates a level of influence on operation sound by the context item 4 when the context item 2 is at ON state. The second column in the fourth row in this case indicates, since being "Yes", that the ON/OFF state as the operation status of the context item 4 is concerned with an influence on operation sound when the context item 2 is at ON state.

In contrast, the second column from the left in the first row from the top indicates, since being "No", that the context item 1 is not concerned with an influence on operation sound when the context item 2 is at ON state. Here, for a method of determining whether to have an influence on operation sound, the same method explained in the first example, i.e., the change amount on the frequency axis is used.

At step S15, the level of influence on operation sound of all the context items is analyzed by using the data illustrated in Table 5. By looking at the fourth row, it is found that the context item 4 is the strongest context item since the context item 4 is of influence on operation sound at all times irrespective of operation statues of the other context items. It is found that the context item 1 is the weakest context item since the context item 1 comes to have no influence on operation sound when any of the other context items is at ON state. It is found that the context items 2 and 3 come to have no influence on operation sound when the context item 4 is at ON state, and are of influence on operation sound when the context items 2 and 3 are in operation each other without influence by the context item 1. In other words, it is understood that the context items 2 and 3 are of influence of almost the same level to each other between the context items 1 and 4. To sum up the above, the relationship in the level of the context items is found to be 4>3=2>1.

Here, it is assumed that in a case where a focused context item has an influence on operation sound when an influencing context item is at ON state, the focused context item has an influence on operation sound even when the influencing context is at OFF state. Besides, it is assumed that "4>1" is true at any time as long as "4>3" and "3>1" are true in level, and a relationship like the rock-paper-scissors indicated by "4>3, 3>1, and 1>4" will never be satisfied.

Next, the operation status table generator 103*b* performs clustering of the operation statuses based on the relationship in level of the context items "4>3=2>1", generates the operation status table 104 as illustrated in Table 6 below (step S16) and the flow illustrated in FIG. 5 is ended.

The feature comparing unit 103*a* functions as an item detector that detects an item having an influence on operation sound of the image forming device 2 in executing steps S13 and S14 and functions as a correlation detector that detects a correlation, among the items detected by the item detector, in influence on operation sound in executing step S15. The operation status table generator 103*b* functions as a second operation status table generator in executing step S16.

TABLE 6

| Operation | Context item | | | |
|---|---|---|---|---|
| status | 1 | 2 | 3 | 4 |
| 1 | * | * | * | ON |
| 2 | * | ON | ON | OFF |

TABLE 6-continued

| Operation status | Context item 1 | 2 | 3 | 4 |
|---|---|---|---|---|
| 3 | * | OFF | ON | OFF |
| 4 | * | ON | OFF | OFF |
| 5 | ON | OFF | OFF | OFF |
| 6 | OFF | OFF | OFF | OFF |

In this operation status table, a mark "*" (wild card) indicates that ON state and OFF state make no difference.

Since the procedure of generating an operation status table as the first example is a method of evaluating an influence on operation sound by a focused context item itself and the second example is a method of evaluating a relationship with other context items, it is possible not only to selectively use the two methods but also to use the two methods at the same time.

According to the first embodiment as explained so far, it is possible by performing clustering of operation statuses to increase a relative amount of operation sound data available for each operation status. Then, it is thereby possible to enhance the approximation accuracy of model expressing operation sounds and improve the detection accuracy.

Next, a second embodiment will be explained. Since context information has an absolute reliability, the second embodiment is intended to aim an improvement of the detection accuracy by further utilizing context information.

In Japanese Laid-open Patent Publication No. 2006-184722, for example, a sequence data sound is calculated from operation sound through a determination of operation sound in an abnormal sound detection routine and the sequence data sound and sequence data stored in advance are compared. While context information is used in the comparison with the sequence data according to the description of Japanese Laid-open Patent Publication No. 2006-184722, the context information has not been used until a processing prior to the comparison. There is therefore a possibility of causing an error at the step prior to the comparison step. Specifically, there is a possibility that error data is input at the comparison step.

For example, when context information is not used in the calculation of sequence data sound, there is a possibility of performing a calculation based on recognition as the operation status 1 by error despite the operation in the operation status 2 in Table 2. Focusing on the operation of the driving motor of the fixing unit (No. 1 in Table 1), the status is ON state in the operation status 1 while the status is OFF state in the operation status 2. Hence, sequence data is calculated by recognizing that the driving motor of the fixing unit is in operation despite no operation thereof in fact and the calculation result is to be input at the comparison step.

When the calculation result including the error is input as input data at the comparison step, validity of the context information is deteriorated due to an effect of the input data including the error even by using the context information at the comparison step. Specifically, even though the driving motor of the fixing unit is not in operation and there is therefore no possibility of causing an abnormity concerning this module, the driving motor of the fixing unit is included in candidates of the result of an ultimate abnormity determination due to the calculation result. There is therefore a possibility of false detection.

To deal with the possibility, context information is further utilized in the second embodiment. More specifically, an operation status is grasped based on context information and candidates for possible abnormity to arise are narrowed down depending on the operation status. Besides, context information other than operation information of each of internal modules is also utilized.

The second embodiment will be explained below with reference to accompanying drawings. An explanation of the same portion as the first embodiment will be omitted here.

Figure 6:
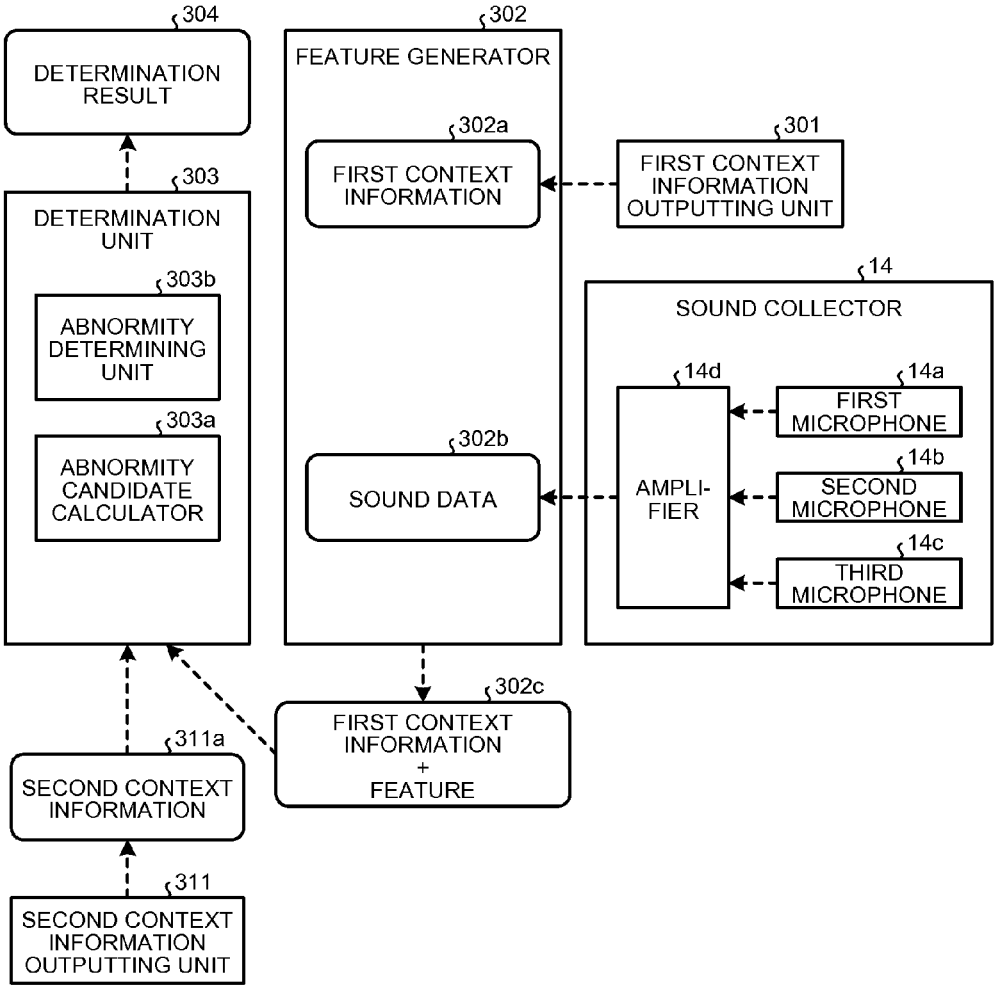
FIG. 6 is a block diagram for explaining a function of an information processing apparatus according to a second embodiment.

FIG. 6 is a block diagram for explaining a function of a computer 1 according to the second embodiment. While the context information obtaining unit 101 is provided in the first embodiment, a first context information outputting unit 301 and a second context information outputting unit 311 are provided in the second embodiment. While the clustering unit 103 is provided in the first embodiment, a determination unit 303 is provided in the second embodiment.

The first context information outputting unit 301 obtains from the image forming device 2 via the communication I/F unit 12 and outputs to a feature generator 302 first context information 302*a*, similarly to the context information obtaining unit 101. The first context information 302*a* is, for example, context information illustrated in Tables 1 and 2.

The feature generator 302 outputs, as an output 302*c* to the determination unit 303, feature data in which context information is temporally synchronized based on the first context information 302*a* and sound data 302*b* input from the sound collector 14.

The output 302*c* is a set of the feature data generated from the sound data 302*b* and context information based on an operation status in recording the sound data. More specifically, the output 302*c* includes "feature data extracted from sound data from time point t1 to time point t2" and "context information to the effect that the conveyance motor is in operation at the same time".

Here, the feature data is 8 to 64 dimensional data in which frequency property is compressed, similarly to the first embodiment.

The second context information outputting unit 311 outputs second context information 311*a* to the determination unit 303. The second context information 311*a* is, for example, information illustrated in Table 7 below.

TABLE 7

| Context information | First context information when abnormity (1) occurs | First context information when abnormity (2) occurs |
|---|---|---|
| Driving motor of fixing unit | * | * |
| Conveyance motor | ON | * |
| Speed-up zone of paper | Paper present | * |
| Manual conveyance motor | ON | * |
| Ozone fan | * | ON |
| Number of rotations of ozone fan | * | High |
| Light emission of LED | * | * |
| Remaining amount of toner | * | * |
| Manual conveyance roller | ON | * |

In the second context information 311*a*, operation statuses of respective contest items when various abnormities occur are collected up. For example, when an abnormity (1) occurs, the "conveyance motor", the "manual conveyance motor", and the "manual conveyance roller" are at the state of "ON", the "speed-up zone of paper" is at a state of "paper is present", and the other context items are at any status.

While the first context information 302*a* is generated by automatically being extracted in accordance with the operation status of the machine, the second context information 311*a* is artificially generated and stored in advance in a storage unit such as the EEPROM 10*d* or provided from an outside via a manual input by an operator. While a possible value of each context item is any one of binary in the first context information 302*a*, the second context information 311*a* is not limited to the binary as illustrated in Table 7.

The determination unit 303 is provided with an abnormity candidate calculator 303*a* and an abnormity determining unit 303*b*. When the determination unit 303 receives an input of the output 302*c* and the second context information 311*a*, the abnormity candidate calculator 303*a* first extracts a possible abnormity to arise from various abnormities collected in the second context information 311*a* and outputs the extracted abnormity as a candidate to the abnormity determining unit 303*b*.

When the operation status 1 (first context information 302*a*) is set in the feature data in the output 302*c*, for example, it is understood that there is a possibility that the abnormity (1) has occurred and is no possibility that the abnormity (2) has occurred based on the second context information 311*a*. Therefore, the abnormity candidate calculator 303*a* treats the abnormity (1) as a candidate and rules out the abnormity (2) as a candidate.

Figure 7:
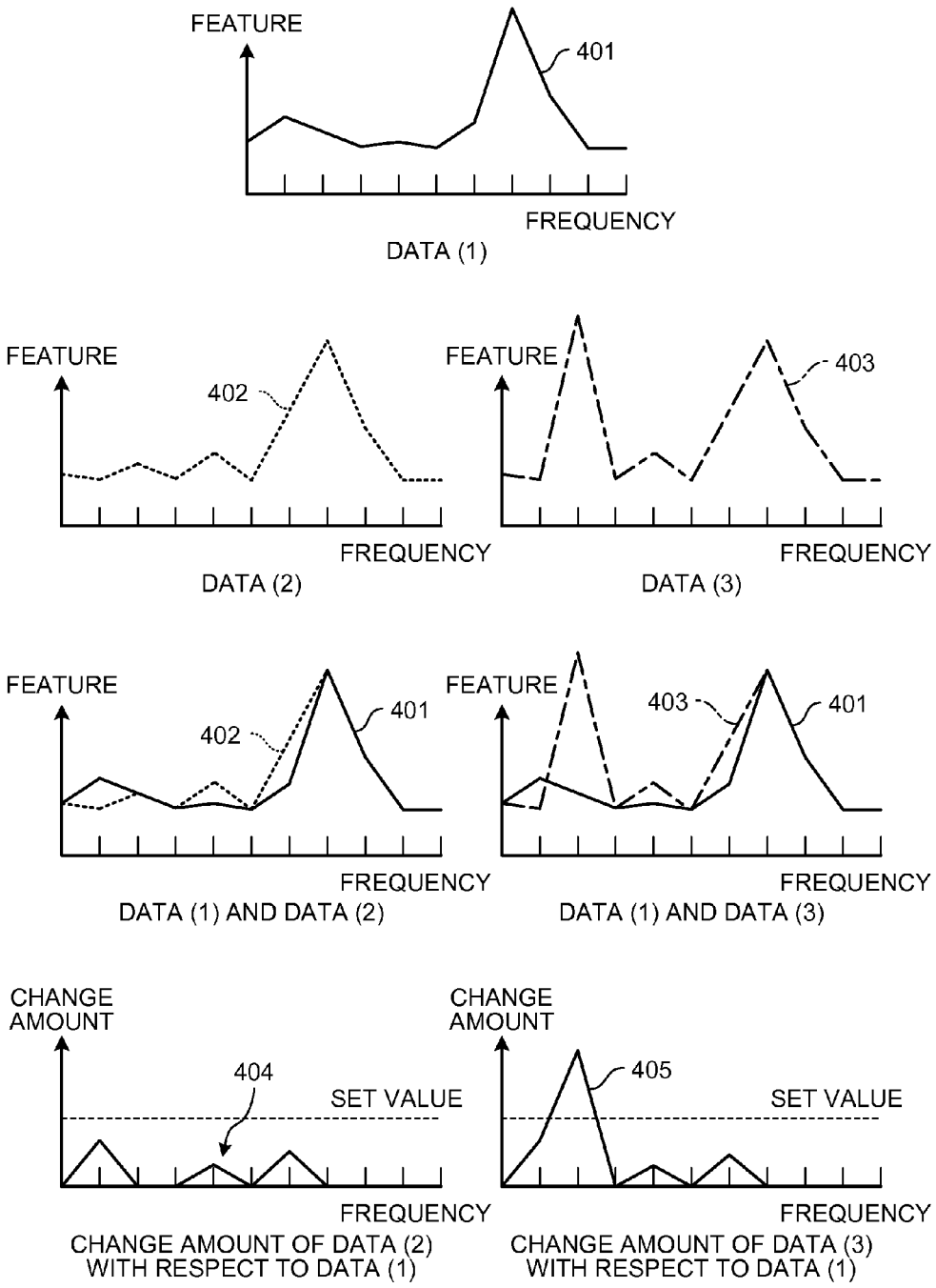
FIG. 7 illustrates graphs for explaining operations of a feature generator and an abnormity determining unit according to the second embodiment.

Next, the abnormity determining unit 303*b* determines whether or not an abnormity has occurred concerning the candidate output by the abnormity candidate calculator 303*a*. An example of this determination processing will be explained with reference to FIG. 7. FIG. 7 illustrates graphs for explaining operations of the feature generator 302 and the abnormity determining unit 303*b* in FIG. 6.

Data (1) is feature data (initial value) 401 that is generated from normal sound data and indicates normality in the first context information at the time when the abnormity (1) occurs. The feature data 401 is stored in the abnormity determining unit 303*b* in advance.

Data (2) and (3) are respectively feature data (current value) 402 and 403 generated from the sounds collected by the first to the third microphones 14*a* to 14*c*.

The abnormity determining unit 303*b* compares the data (1) with the data (2) like the left on the third stage from the top in FIG. 7 and calculates a change amount (gap) from the feature data 401 to the feature data 402 for each dimension. A result of the calculation is a change amount 404 of the data (2) with respect to the data (1) illustrated at the left on the fourth stage from the top in FIG. 7.

While there is a part (dimension) where the change amount 404 is not zero, i.e., a part (dimension) where a change from the initial value to the current value is present in the graph of the change amount 404, there is no part where the change amount 404 exceeds a set value (threshold). Hence, the abnormity determining unit 303*b* determines that the data (2) is normal.

Similarly, the abnormity determining unit 303*b* compares the data (1) with the data (3) (the right on third stage from the top in FIG. 7) and calculates a change amount (gap) from the feature data 401 to the feature data 403 for each dimension. A result of the calculation is a change amount 405 of the data (3) with respect to the data (1) (at the right on the fourth stage from the top in FIG. 7).

In the graph of the change amount 405, there is a part where the change amount 405 exceeds the set value (threshold) among parts (dimensions) where the change amount 405 is not zero, i.e., where a change from the initial value to the current value is present. Hence, the abnormity determining unit 303*b* determines that the data (3) is abnormal.

Here, it is possible to set an arbitrary value for the set value.

Figure 8:
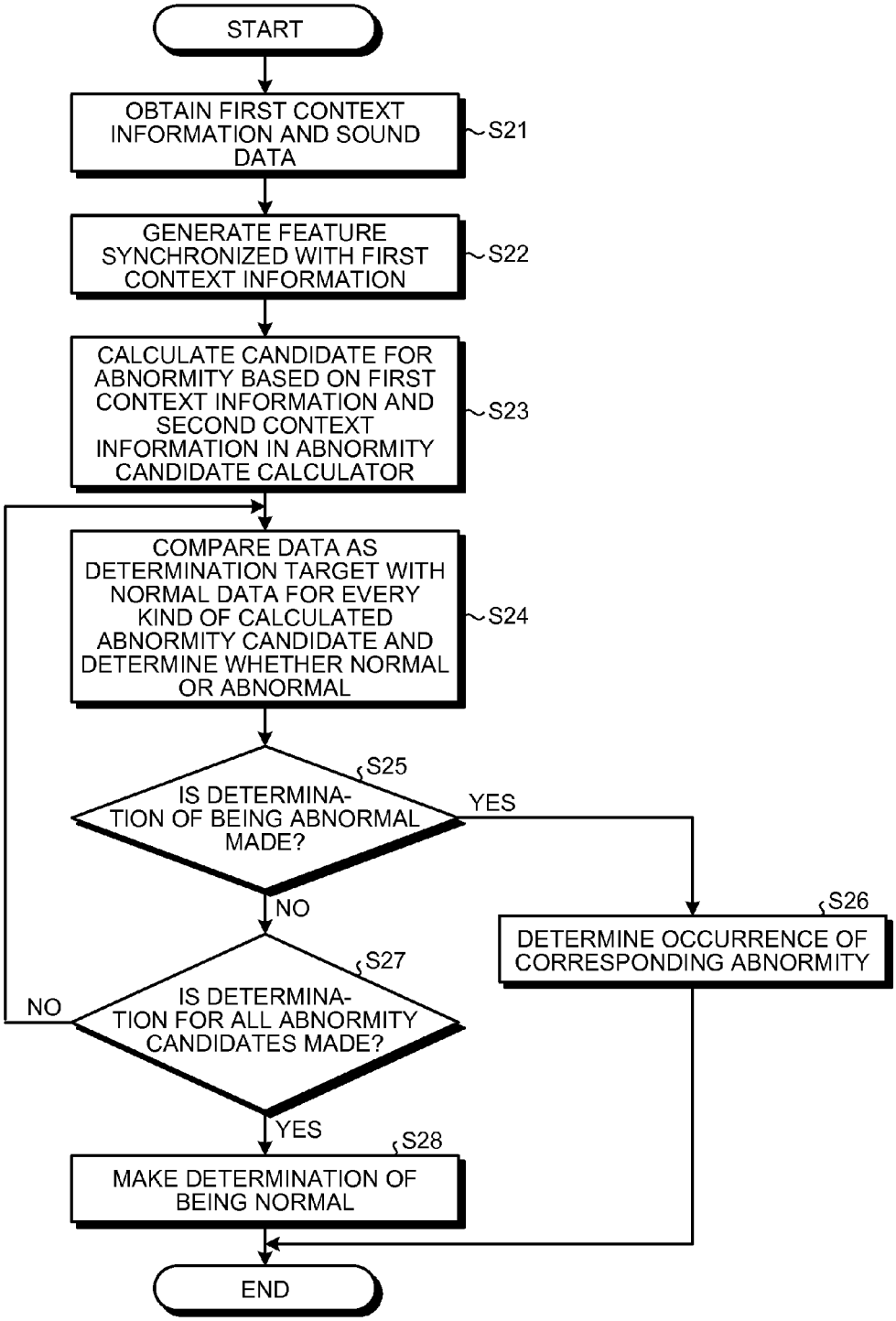
FIG. 8 is a flowchart of an example of a procedure of a processing up to an abnormity determination in the information processing apparatus according to the second embodiment.

A flow of the processing up to the abnormity determination will be explained with reference to FIG. 8. FIG. 8 is a flowchart of an example of a procedure of the processing up to the abnormity determination in the computer 1. The feature generator 302 first obtains the first context information 302*a* and the sound data 302*b* from the first context information outputting unit 301 and the sound collector 14, respectively (step S21). The feature generator 302 then generates feature data which is synchronized with the first context information 302*a* (step S22).

Next, the abnormity candidate calculator 303*a* calculates a candidate for abnormity based on the first context information 302*a* and the second context information 311*a* (step S23). The abnormity determining unit 303*b* then treats all kinds of abnormity candidates calculated by the abnormity candidate calculator 303*a* as a determination target and determines whether the determination target is normal or abnormal in comparison with normal data (step S24).

When a result of the most recent determination by the abnormity determining unit 303*b* at step S24 is "abnormal" ("Yes" at step S25), the determination unit 303 outputs a determination result 304 to the effect that a corresponding abnormity has occurred (step S26) and ends the processing.

When the result of the most recent determination by the abnormity determining unit 303*b* at step S24 is "normal" ("No" at step S25) and when the determination with respect to all the abnormity candidates is not made ("No" at step S27), the determination unit 303 returns the processing to step S24.

When the determination with respect to all the abnormity candidates is made at step S27 ("Yes" at step S27), the determination unit 303 outputs "Normal" as the determination result 304 (step S28) and ends the processing.

According to the second embodiment as explained so far, it is possible to prevent fault determinations for two kinds of situations, i.e., "the situation of determining that the abnormity (2) has occurred despite being normal" and "the situation of determining that the abnormity (2) has occurred despite being the abnormity (1)". According to the second embodiment, it is therefore possible to improve the determination accuracy.

Next, a third embodiment will be explained. A third embodiment is a modification of the second embodiment. In the third embodiment, an explanation of the same portion as the second embodiment will be omitted and a portion different from the second embodiment will be explained.

Figure 9:
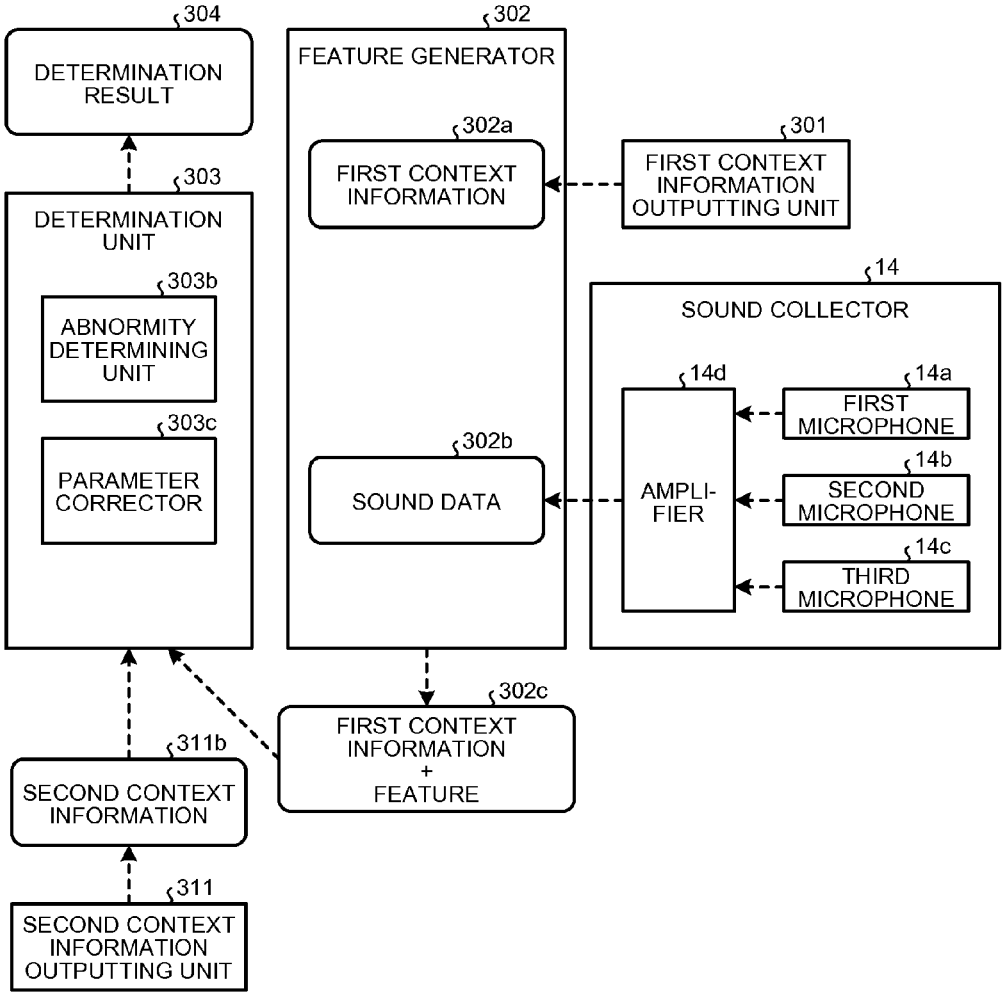
FIG. 9 is a block diagram for explaining a function of an information processing apparatus according to a third embodiment.

FIG. 9 is a block diagram for explaining a function of a computer 1 according to the third embodiment. In the third embodiment, a parameter corrector 303*c* is provided in place of the abnormity candidate calculator 303*a* in the second embodiment. The parameter corrector 303*c* corrects parameters used by the abnormity determining unit 303*b*.

In the third embodiment, second context information 311*b*, which is different from the second context information 311*a* in the second embodiment, is used. Table 8 illustrates an example the second context information 311*b*.

TABLE 8

| Context item | Influencing parameter in abnormity determining unit | | |
|---|---|---|---|
| | Parameter A used in abnormity determining unit | Parameter B used in abnormity determining unit | . . . |
| Machine's ambient noise level | YES | NO | . . . |
| Machine's usage frequency | NO | NO | . . . |
| Machine's accumulated operation time | NO | YES | . . . |
| Machine's ambient temperature and humidity | NO | NO | . . . |
| . | . | . | . . . |
| . | . | . | |
| . | . | . | |

The second context information 311*b* is provided via a manual input via the operation display unit 11 (however, the invention is not limited to this configuration in practice). The second context information 311*b* indicates whether or not each context item has an influence on parameters used in the determination unit 303. A parameter A is, for example, a threshold (set value) used for a determination, by in the abnormity determining unit 303*b*, on being normal or abnormal in change amount. A parameter B is, for example, ON/OFF in a dimension of usage of feature data. Context items includes "machine's ambient noise level", "machine's usage frequency", "machine's accumulated operation time", and "machine's ambient temperature and humidity", for example.

When an ambient noise is big, for example, there arises a necessity of making a threshold large since a value (output, power) in the longitudinal direction becomes large in whole in feature data. Therefore, a description "YES" is provided for the parameter A (threshold) of the context item "machine's ambient noise level" of the second context information 311*b*. The parameter corrector 303*c* refers to the second context information 311*b* and corrects the threshold (parameter A) to be larger value when the "machine's ambient noise level" is big.

Besides, it is found based on the second context information 311*b* that the "machine's accumulated operation time" has an influence on the parameter B (dimension of usage). The parameter corrector 303*c* limits the dimension to be used in the abnormity determining unit 303*b* to one to five dimensions when the accumulated operation time is short in a case where the number of dimensions of the feature data is 10, for example and performs a correction of increasing the number of dimensions of usage gradually up to 10 dimensions in accordance with the increase in the accumulated operation time.

It is thus possible to use more appropriate feature data and threshold depending on the status of each of the context items listed in the second context information 311*b* and thereby improve the determination accuracy.

Figure 10:
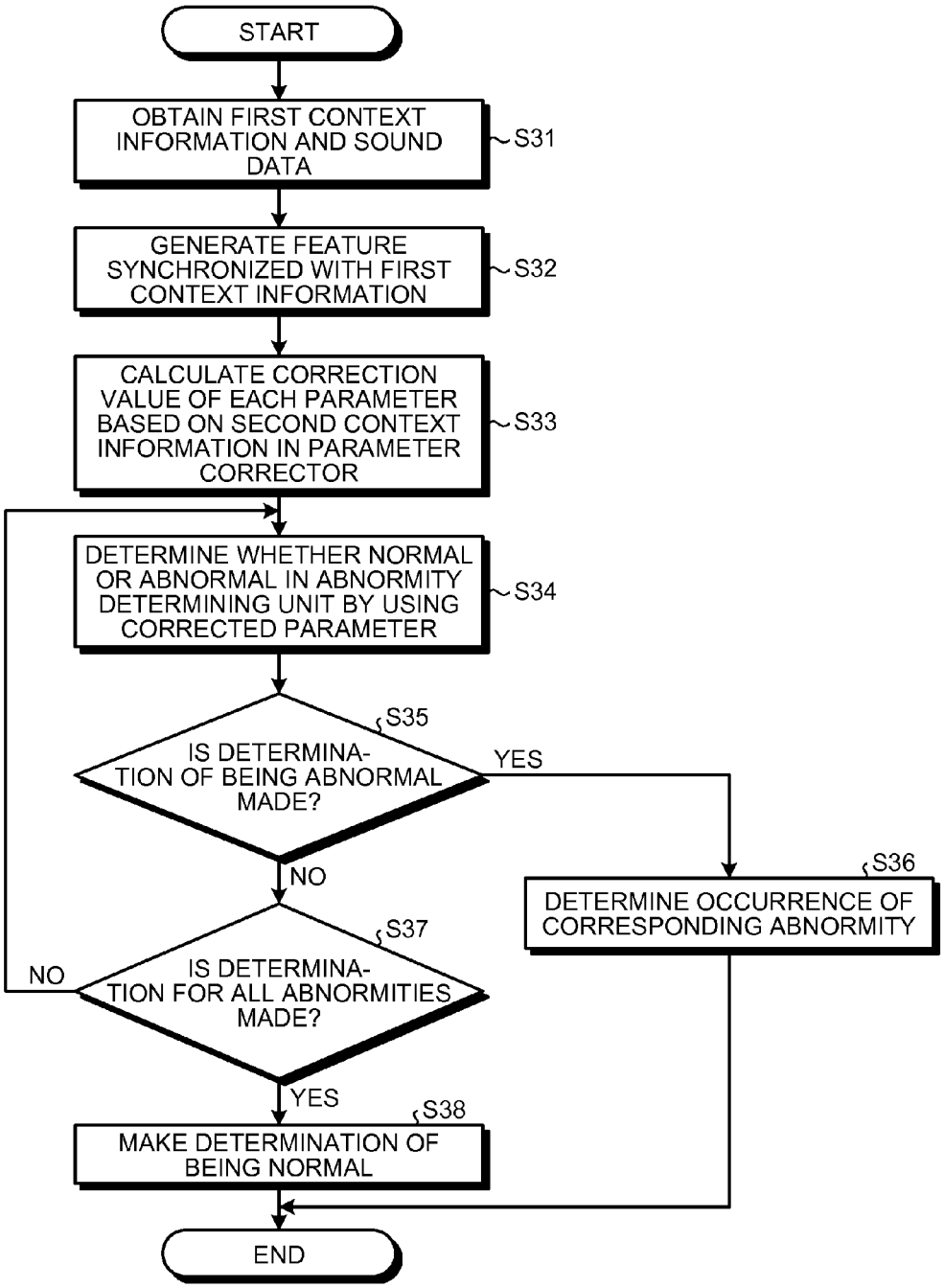
FIG. 10 is a flowchart of an example of a procedure of a processing up to an abnormity determination in the information processing apparatus according to the third embodiment.

A flow of the processing up to the abnormity determination will be explained with reference to FIG. 10. FIG. 10 is a flowchart of an example of a procedure of the processing up to the abnormity determination in the computer 1. Steps S31 and S32 are the same as steps S21 and S22 in the second embodiment.

At step S33, the parameter corrector 303*c* calculates a correction value of each parameter based on the second context information 311*b* (step S33). The abnormity determining unit 303*b* uses the corrected parameter to determine whether the feature data is normal or abnormal (step S34).

When the determination of being abnormal is made in the abnormity determining unit 303*b* ("Yes" at step S35), the determination unit 303 outputs the determination result 304 indicating an occurrence of abnormity (step S36) and ends the processing. When the determination of being abnormal is not made at step S35 ("No" at step S35), the determination unit 303 returns the processing to step S34 until the determination with respect to all the determination targets is made ("No" at step S37). When the determination with respect to all the determination targets is made ("Yes" at step S37), the determination unit 303 outputs the determination result 304 indicating normality (step S38) and ends the processing.

According to the third embodiment as explained so far, it is possible to improve the determination accuracy since parameters used for abnormity determination can be corrected depending on an ambient condition and a usage situation of a machine.

While the embodiments explained above are related to a system in which the computer 1 collects operation sounds of the image forming device 2, it is possible to make a configuration such that the image forming device 2 itself collects operation sounds. In this configuration, the control unit 20 of the image forming device 2 is configured to function as components other than the sound collector 14 in FIG. 2.

According to the embodiments, the information processing apparatus is capable of enhancing the approximation accuracy of model expressing operation sounds of a device such as an image forming device and improving the accuracy of the detection of abnormal sounds.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An information processing apparatus comprising:

a memory and a processor, the memory containing computer readable code that, when executed by the processor, configures the processor to, collect an operation sound of a sound collection target device to obtain sound data, obtain context information at a time of an operation of the sound collection target device;

generate feature of sound data corresponding to the context information, and generate an operation status table of the sound collection target device using the feature by, detecting an item having an influence on operation sound of the sound collection target device among items of the context information, and performing clustering of operation statuses of the sound collection target device based on the item detected to generate the operation status table.

2. The information processing apparatus according to claim 1, wherein the operation statuses include a combination of items detected by the processor.

3. The information processing apparatus according to claim 1, wherein the computer readable code, when executed by the processor, further configures the processor to, detect a correlation of influence on operation sound among items detected by the processor, and perform clustering of operation statuses of the sound collection target device based on the correlation detected by the processor to generate the operation status table.

4. The information processing apparatus according to claim 3, wherein the processor detects a relationship of level of influence on operation sound of the items detected by the processor.

5. The information processing apparatus according claim 1, wherein the computer readable code, when executed by the processor, further configures the processor to, detect a correlation of influence on operation sound among items detected by the processor, and perform clustering of operation statuses of the sound collection target device based on the correlation detected by the processor to generate the operation status table.

6. The information processing apparatus according to claim 5, wherein the computer readable code, when executed by the processor, further configures the processor to, select a selected one of the item detected by the processor and the correlation detected by the processor, and generate the operation status table by performing clustering of the operation statuses of the sound collection target device based on the selected one of the item detected by the processor and the correlation detected by the processor.

7. An information processing method in an information processing apparatus, the information processing method comprising:

collecting an operation sound of a sound collection target device to obtain sound data;

obtaining context information at a time of an operation of the sound collection target device;

first generating feature of sound data corresponding to the context information; and second generating an operation status table of the sound collection target device by using the feature, the second generating including, detecting an item having an influence on operation sound of the sound collection target device among items of the context information, and performing clustering of operation statuses of the sound collection target device based on the item detected by the detecting to generate the operation status table.

8. A non-transitory computer-readable storage medium with an executable program stored thereon and executed by a computer of an information processing apparatus, wherein the program instructs the computer to perform:

collecting an operation sound of a sound collection target device to obtain sound data;

obtaining context information at a time of an operation of the sound collection target device;

first generating feature of sound data corresponding to the context information; and second generating an operation status table of the sound collection target device by using the feature, the second generating including, detecting an item having an influence on operation sound of the sound collection target device among items of the context information, and performing clustering of operation statuses of the sound collection target device based on the item detected by the detecting to generate the operation status table.

* * * * *